United States Patent [19]

Seglin

[11] 3,993,583

[45] Nov. 23, 1976

[54] GASIFICATION OF ASH CONTAINING CARBONACEOUS SOLIDS

[75] Inventor: Leonard Seglin, New York, N.Y.

[73] Assignee: COGAS Development Company, Princeton, N.J.

[22] Filed: Mar. 17, 1976

[21] Appl. No.: 667,540

[52] U.S. Cl. ..... 252/373; 48/197 R; 48/202; 48/206

[51] Int. Cl.[2] ..... C01B 2/02; C10J 3/54; C10K 1/02

[58] Field of Search ..... 48/197 R, 202, 206; 252/373; 423/415 R, 415 A, 650

[56] References Cited

UNITED STATES PATENTS

| | | | |
|---|---|---|---|
| 2,729,552 | 1/1956 | Nelson et al. | 48/197 R |
| 2,879,148 | 3/1959 | Atwell | 48/197 R X |
| 2,890,107 | 6/1959 | Flesch et al. | 48/197 R X |

*Primary Examiner*—Joseph Scovronek

[57] ABSTRACT

In the process of making synthesis gas in a fluidized bed from carbon and steam, wherein a recirculating stream of carbon from the bed is heated externally of the bed with combustion gases derived by burning carbonaceous solids taken from the bed, using all the fines separated from the synthesis gas withdrawn above the fluidized bed, and such additional carbon from the bed as is necessary to make up the required heat balance, the ash content of the bed is maintained near feed levels by drawing char from the bed, fractionating it to obtain an ash-rich fraction and an ash-poor fraction, returning the ash-poor fraction to the gasifier and sending the ash-rich fraction to the combustor.

3 Claims, 1 Drawing Figure

GASIFICATION OF ASH CONTAINING CARBONACEOUS SOLIDS

Figure 1:
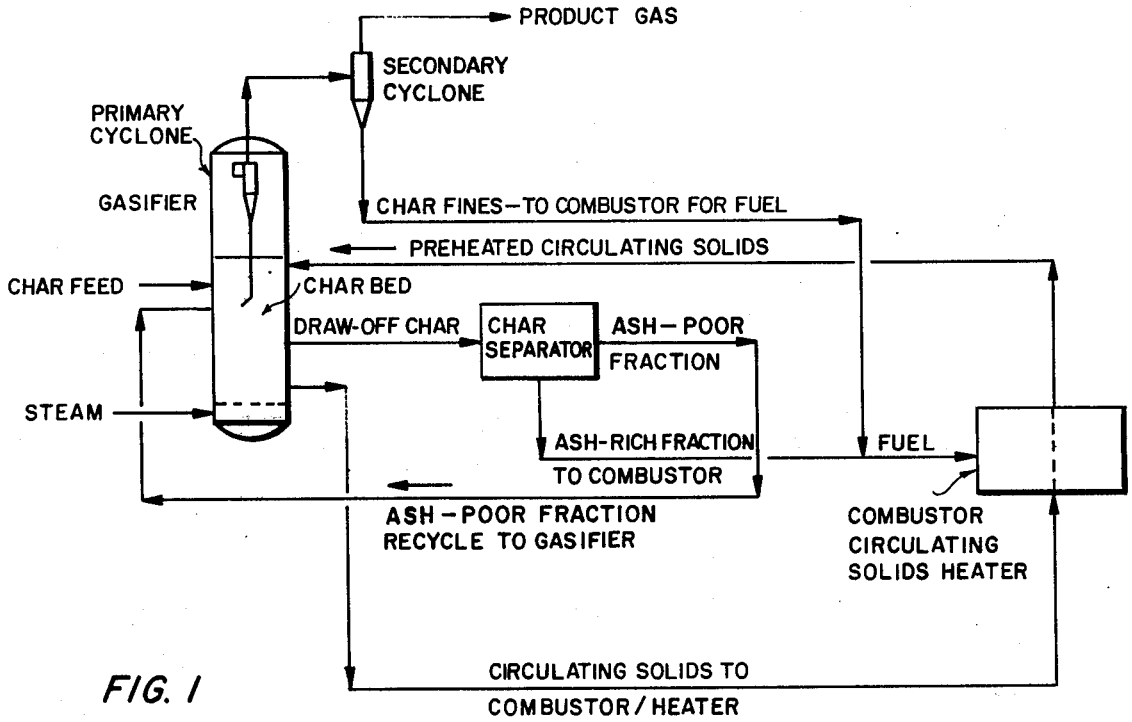

This invention relates to the gasification of carbonaceous solids in a fluidized bed and is particularly concerned with improvements for supplying heat to the gasification zone.

Synthesis gas is an important and basic raw material from which numerous industrial chemicals are manufactured. It is a mixture of hydrogen and carbon monoxide and is formed by contacting steam with hot carbon, the so-called water gas reaction, in accordance with the following equation:

$$\underset{\text{Steam}}{C + H_2O} \xrightarrow{1600^\circ F} CO + H_2$$

On catalytic treatment at 400° to 1100° F, synthesis gas can be converted into methane or substitute natural gas (SNG) as it is referred to in the energy and fuel arts. Such technology is under extensive investigation as part of an overall effort to develop a practical system of producing SNG wherein the intermediate synthesis gas is obtained by the gasification of coal or coal derived carbon.

One method of carrying out the synthesis gas reaction consists in passing steam through a fluidized bed of carbonaceous material. This approach provides intimate contact between the steam and finely divided carbon resulting in a high degree of reaction efficiency. Although the application of fluidization techniques constitutes an advance in synthesis gas generation, the provision of heat for sustaining the intensely endothermic steam-carbon reaction is difficult to implement. A simple solution is to introduce air with the fluidizing steam and burn a portion of the carbon. However, the resulting synthesis gas contains nitrogen. Pure oxygen can be used but it adds to the cost.

A proposal which avoids the deficiencies of internal combustion for sustaining a synthesis gas generator involves the withdrawal of a quantity of carbonaceous solids from the gasification zone and dividing it into two separate streams. One stream is burned in a combustor and the other stream passed through the hot combustion gases and then conveyed back to the reactor along with fresh carbonaceous solids, to provide substantially all of the necessary heat of reaction between carbon and steam. Such a recycle scheme is illustrated in U.S. Pat. No. 3,440,177 to Patton et al. issued Apr. 22, 1969.

An undesirable characteristic associated with the fluidized gasification of carbon is the formation of fines which tend to be blown out of the fluidized reactor with the synthesis gas. These fines either are lost or must be recovered and returned to the process at some expense. In addition, the buildup of fines necessitates reduction in gas velocity in the reactor, thereby reducing overall throughput.

A preferred method of handling the fines is to burn them to provide a source of heat for the steam-carbon reaction. In this method, which is disclosed in U.K. Pat. No. 1,312,860, the carbon fines separated from the synthesis gas, are fed to a slagging combustor, where they are burned with air to provide the heat for the gasifier. The hot combustion gases are employed to entrain and disperse a recirculating stream of carbonaceous solids from the gasifier, and heat the stream very rapidly to the desired temperature. Typically, heat transfer is essentially complete in a fraction of a second; contact time should not be more than a few seconds (two to three) to avoid loss of carbon by its reaction with the carbon dioxide and steam in the extraining combustion gas. In order to keep the system in heat balance, some carbon must be withdrawn from the bed and burned along with the fines. The carbon reactant is finely divided char produced by the fluidized carbonization of coal as described in U.S. Pat. No. 3,375,175.

In operating a large pilot plant with the process aforesaid, it was found that ash accumulates in the gasifier because some molten ash is entrained from the combustor as minute droplets of slag which are recycled to the gasifier with the circulating char stream. This, and other high ash material, tend to collect at the bottom of the gasifier. It was also observed that the char fines contain about the same concentration of ash as the fresh char feed to the gasifier. Since the char fines are considerably less in weight than the char feed, the ash removed from the system by burning the char fines in the combustor will be less than that in the char feed. Additional ash must be removed to maintain the system in ash balance. This can be done by withdrawing a char stream from the gasifier. By so doing, carbon will also be removed. The amount of carbon that can be used is fixed by the heat requirements for the system.

In accordance with the present invention, it has been discovered that in the process of gasifying ash-containing carbon with steam in a fluidized bed gasifier wherein carbon fines, separated from the synthesis gas, are burned in a slagging combustor, the combustion gases are used to disperse a recycle stream of carbon from the fluidized bed gasifier to heat the recycle stream, the recycle stream is separated from the combustion gases to minimize reaction therewith and the recycle stream is returned to the fluidized bed gasifier to yield up its heat for the gasification reaction, ash buildup in the gasifier is controlled while supplying additional heat to the gasification reaction comprising the steps of:

a. withdrawing a second stream of char from the fluidized gasifier bed;

b. separating said second stream into an ash-rich portion and an ash-poor portion;

c. feeding the ash-rich portion into the combustor to be burned with the fines;

d. feeding the ash-poor portion into the fluidized bed gasifier said second stream being withdrawn at a rate at least sufficiently high so that as much ash is removed from the fluidized bed gasifier as is introduced into it with fresh feed.

The stream of carbon withdrawn from the gasifier and fed to a separation zone may be at the minimum rate necessary to maintain the ash in balance, i.e., to recover as much ash from the system as is being fed to it with the fresh carbon feed. Most preferable, the rate of withdrawal and separation is much higher than this minimum rate, thereby the ash contact of the bed will be significantly lower, resulting in much improved capacity in the gasifier because of the higher carbon content of the bed.

The single FIGURE drawing shows a flow sheet of the invention.

In accordance with the invention, the heat required for the fluidized gasifier is supplied by preferential burning of the finest-size material produced in the process, so that some of the heat is supplied and the fines problem is controlled at the same time; the balance of the heat required is supplied by combustion of a stream of ash enriched carbon derived by separation of a circulating carbon stream from the gasifier into an ash-rich fraction and an ash-poor fraction. The latter fraction is returned to the gasifier. The products of the combustion of the carbon fines and the ash-rich carbon are mixed with a recycle stream of carbon from the gasifier, thereby heating the recycle stream to a temperature sufficiently high so that, on recycle to the gasifier, sufficient heat is provided to the gasifier bed to support the steam-carbon reaction. The contact time between the combustion gases and the circulating carbon is kept low, to minimize side reactions of carbon with carbon dioxide and steam in those combustion gases.

The heat supplied by the fines is insufficient for heat balance so that additional fuel must be provided by burning carbon withdrawn from the body of the fluidized bed. By well-known separation techniques, a stream of carbon withdrawn from the gasifier, can be fractionated into an ash-rich fraction and an ash-poor fraction. Using the ash-rich for fuel has the beneficial effect of increasing the carbon level in the gasifier, thereby raising the capacity of the gasifier. The ash-poor fraction is returned to the fluidized bed gasifier. The amounts withdrawn from the bed depend on the amount of carbon needed for combustion, on the efficiency of the ash-carbon separator, and on the amount of ash which must be removed, which in turn depends on the ash content and nature of the carbon.

Referring to the drawing which shows a labeled flow sheet of the process of the invention, there is provided a gasifier containing therein a bed of char, produced by the fluidized bed carbonization of coal in accordance with the aforecited U.S. Pat. No. 3,375,175, maintained on a grid by a fluidizing stream of superheated steam. Char feed enters the gasifier directly or by way of the char recycle line.

In the gasifier, the hot char reacts with steam to form synthesis gases, mostly carbon monoxide and hydrogen, but also containing some carbon oxysulfide; carbon dioxide, steam and sulfur gases (hydrogen sulfide). These gases, carrying suspended char solids, are passed through a cyclone system where the entrained solids are separated from the synthesis gas product. The larger solids in the primary cyclone are returned to the gasifier, while the finer solids in the secondary cyclone are conveyed to a combustor.

The solids fed to the combustor are selectively the finest char solids coming from the gasifier. The burning of these char fines prevents their buildup in the system, thus reducing the load on the cyclones with consequent savings in capital investment and plant maintenance. At the same time, such selective removal of fines stabilizes the size consist of the bed solids, permitting a high gas velocity without blowing the solids out of the bed.

The combustor is preferably a slagging combustor, in which the ash content of the fuel is expelled as molten slag, free of carbon. The combustion of the fines removes all the ash that is blown overhead from the gasifier but, as pointed out above, this is insufficient to prevent the ash content of the material in the gasifier from building up to excessively high levels.

Ash control is effected in the herein process by drawing off char from the gasifier and separating the char into an ash-rich fraction which goes to the combustor and an ash-poor fraction which returns to the gasifier.

The combustor is operated with air preferably preheated up to 1000° F. The hot combustion gases from the combustor contact the stream of recycle solids taken from near the bottom of the gasifier and the reheated solids returned to the gasifier. The exit line from the combustor is long enough so that the recycle solids can absorb the heat from the hot combustion gases, but not so long as to permit any significant reaction between the char and the carbon dioxide and steam in the combustion gases.

Assuming the recycle char is heated to 1900° F, and the combustion gases enter the char-gas mixing zone at about 4000° F, less than 0.1 second is required after mixing of solids and gas to raise the temperature of the average-size solids to 1900° F. To minimize the reaction between the carbon dioxide and steam in the combustion gases with carbon in the char, the contact time in the char-gas heat exchanger is kept to a few seconds, preferably not more than 3 seconds. The heated solids are returned to the gasifier to supply heat to that vessel.

The apparatus of the invention may be combined with the apparatus of the cited U.S. Pat. No. 3,375,175 to achieve high yields of coal-derived liquids.

The process used in the ash separator may be selected as desired from a number of known techniques such as a fluidized bed. In this procedure, the fluidizing velocity is adjusted whereby the heavy ash-rich fraction sinks and the lighter ash-poor fraction rises; the ash-rich fraction is used as fuel in the combustor while the ash-poor fraction is returned to the gasifier. Other methods are electromagnetic separation, various sink-float techniques, and oscillating tables such as are used in ore dressing.

The following examples are given by way of illustration and not by way of limitation.

EXAMPLE 1

Illustration of Ash Buildup (Prior Art)

A number of batch gasification runs were made with starting char containing 22.1% ash and the results set forth in Table I. As the data show, there is a buildup of ash in the fluidized bed with time as more and more carbon undergoes gasification.

EXAMPLE 2

Illustration for Controlling Ash Buildup by the Process of the Invention 100 pounds per hour of char having the same analysis as the feed char of Example 1, was fed to a gasifier operating at 1600° F and 50 psi for a period of 10 hours. The composition of the gasifier bed and char fines are given in Table II.

It is to be noted that 22.1 pounds per hour of ash is being fed to the gasifier, and 22.1 pounds are being withdrawn (10.7 in the fines, 2.2 in the extra char needed for heat balance, and 9.2 in the char needed to be withdrawn to satisfy the ash balance). At this equilibrium rate of withdrawal, the gasifier contains about 2.5 times as much ash as the feed. Note further that a deliberate loss of 7. 3 pounds per hour of carbon (9.9% of total feed, and 10.9% of the carbon gasified) was required to maintain the ash in balance. This loss was prevented by recovering the gasifier bed char and by maintaining a fluid-bed of this material at slightly above its minimum fluidizing velocity, an ash-rich fraction was recovered in the underflow and an ash-poor (carbon-rich) fraction was recovered in the overflow. The streams and their compositions are given in Table III.

EXAMPLE 3

Illustration Showing Increased Capacity

In this example, the char flow from the gasifier to ash-enriching fluid-bed was increased from 27.0 pounds per hour to 100 pounds per hour giving the following results summarized in Table IV.

The carbon content of the gasifier bed increased from 43.8 to 66.4%, and the gasification capcity increased proportionately, this is, 52%.

Higher circulation rates can reduce the ash content of the bed even further; the rate selected will depend on the economic tradeoffs between cost of circulation and increased gasifier capacity.

Obviously the examples can be multiplied without departing from the scope of the invention as defined in the claims.

Table I

| Time-hr. | Temp. F. | Pressure psig | Char Analysis (% by weight) Ash | C | H | N | S | Remarks |
|---|---|---|---|---|---|---|---|---|
| 0 | 1600 | 50 | 22.1 | 73.5 | 0.8 | 0.9 | 2.7 | Feed-100 lb. |
| 1.3 | " | " | 31.3 | 66.8 | 0.6 | 0.3 | 1.0 | Gasifier bed material-54 lb. |
| " | " | " | 19.2 | 76.4 | 0.8 | 0.8 | 2.8 | Char fines-27 lb. |
| 3.5 | " | " | 51.2 | 47.5 | 0.4 | 0.2 | 0.7 | Gasifier bed material-29.3 lb. |
| " | " | " | 24.1 | 71.8 | 0.8 | 0.8 | 2.6 | Char fines-29 lb. |

TABLE II

| Weight % | lb. per hour Ash | C | H | N | S | Total | Ash | Carbon |
|---|---|---|---|---|---|---|---|---|
| Gasifier Bed | 55.0 | 43.8 | 0.4 | 0.2 | 0.6 | | | |
| Fines to Slagging Combustor | 22.5 | 73.1 | 0.8 | 0.9 | 2.7 | 47.0 | 10.7 | 35.0 |
| Gasifier bed char to Slagging Combustor to satisfy feed needs | 55.0 | 43.8 | 0.4 | 0.2 | 0.6 | 4.0 | 2.2 | 1.8 |
| Gasifier Bed Char to discard to satisfy ash balance | 55.0 | 43.8 | 0.4 | 0.2 | 0.6 | 16.7 | 9.2 | 7.3 |

Table III

| Weight % | lb./hr. Ash | C | H | N | S | Total | Ash | Carbon |
|---|---|---|---|---|---|---|---|---|
| Gasifier bed char to ash-enriching | 55 | 43.8 | 0.4 | 0.2 | 0.6 | 27.0 | 14.9 | 11.8 |
| Underflow to Combustor | 85.7 | 13.5 | 0.1 | 0.1 | 0.2 | 13.3 | 11.4 | 1.8 |
| Overflow to Gasifier* | 25.5 | 73.0 | 0.6 | 0.3 | 0.9 | 13.7 | 3.5 | 10.0 |

*This extra flow needed to recover ash was due to the inclusion of molten ash droplets in the exit gases from the combustor.

Table IV

| weight % | lb./hr. Ash | C | H | N | S | Total | Ash | Carbon |
|---|---|---|---|---|---|---|---|---|
| Gasifier bed char to ash enriching | 31.9 | 66.4 | 0.5 | 0.3 | 0.8 | 100 | 31.9 | 66 |
| Underflow to Combustor | 85.7 | 13.5 | 0.1 | 0.1 | 0.2 | 13.3 | 11.4 | 1.8 |
| Overflow to Gasifier | 23.7 | 74.5 | 0.6 | 0.3 | 0.9 | 86.7 | 20.5 | 64.6 |

What is claimed is:

1. In the process of gasifying ash-containing carbon with steam in a fluidized bed gasifier wherein carbon fines, separated from the synthesis gas, are burned in a slagging combustor, the resulting combustion gases are used to disperse a recycle stream of carbon from the fluidized bed gasifier to heat the recycle stream, the recycle stream is separated from the combustion gases to minimize reaction therewith and the recycle stream is returned to the fluidized bed gasifier to yield up its heat for the gasification reaction, the improvement wherein ash buildup in the gasifier is controlled while supplying additional heat to the gasification reaction comprising the steps of:

a. withdrawing a second stream of char from the fluidized gasifier bed;

b. separating said second stream into an ash-rich portion and an ash-poor portion;

c. feeding the ash-rich portion into the combustor to be burned with the fines; and d. feeding the ash-poor portion into the fluidized bed gasifier, said second stream being withdrawn at a rate at least sufficiently high so that as much ash is removed from the fluidized bed gasifier as is introduced into it with fresh feed.

2. The method of claim 1, in which the rate of withdrawal of said second stream of carbon is substantially greater than that necessary to remove ash from the system at the rate at which it enters the system.

3. The method of claim 1, in which said second stream is separated by feeding into a fluidized bed maintained slightly above its fluidizing velocity, recovering ash-rich material from the underflow and recovering ash-poor material from the overflow.

* * * * *

UNITED STATES PATENT OFFICE

CERTIFICATE OF CORRECTION

PATENT NO. : 3,993,583

DATED : November 23, 1976

INVENTOR(S) : Leonard Seglin

It is certified that error appears in the above-identified patent and that said Letters Patent are hereby corrected as shown below:

Column 5, line 12, "capcity" should read --capacity--; Column 5, line 13, "this is," should read --that is,--; Columns 5 & 6, Tables II, III, & IV headings should read as follows:

| Weight % | | | | | lb. per hour | | |
|---|---|---|---|---|---|---|---|
| Ash | C | H | N | S | Total | Ash | Carbon |

Column 2, line 60, "contact" should read --content--.

Signed and Sealed this

Eighth Day of March 1977

[SEAL]

*Attest:*

RUTH C. MASON
*Attesting Officer*

C. MARSHALL DANN
*Commissioner of Patents and Trademarks*